United States Patent [19]

Chopra et al.

[11] 4,152,900

[45] May 8, 1979

[54] REFRIGERATION COOLING UNIT WITH NON-UNIFORM HEAT INPUT FOR DEFROST

[75] Inventors: Ram K. Chopra, Trenton, N.J.; Daniel E. Kramer, Yardley, Pa.

[73] Assignee: Kramer Trenton Co., Trenton, N.J.

[21] Appl. No.: 893,512

[22] Filed: Apr. 4, 1978

[51] Int. Cl.[2] ..... F25D 21/00; F25D 21/06

[52] U.S. Cl. ..... 62/80; 62/151; 62/275

[58] Field of Search ..... 62/80, 151, 275, 276; 219/201, 530, 540, 24

[56] References Cited

U.S. PATENT DOCUMENTS

| | | | |
|---|---|---|---|
| 1,998,575 | 4/1935 | Furnas | 62/276 |
| 2,001,323 | 5/1935 | Dick | 62/80 |
| 2,496,143 | 1/1950 | Backstrom | 62/276 |
| 3,013,399 | 12/1961 | Simmons et al. | 62/151 |
| 3,013,400 | 12/1961 | Sharpe | 62/276 |
| 3,464,224 | 9/1969 | Swanson | 62/80 |
| 3,756,037 | 9/1973 | Raufeisen et al. | 62/80 |
| 3,834,176 | 9/1974 | Clarke | 62/276 |

*Primary Examiner*—Lloyd L. King
*Attorney, Agent, or Firm*—Daniel E. Kramer

[57] ABSTRACT

A cooling unit for refrigeration systems having a substantially vertically disposed air cooling element, utilizing either a volatile or a non-volatile refrigerant, upon which element frost accumulates during the course of the refrigeration process. The element includes heaters to periodically warm the element to a temperature above 32° F. to thaw the frost. These heaters have their heating capacity adjusted so that more heat is applied at the bottom portion of the frost-collecting air cooling element and less heat is supplied to the upper portion.

13 Claims, 12 Drawing Figures

REFRIGERATION COOLING UNIT WITH NON-UNIFORM HEAT INPUT FOR DEFROST

BACKGROUND OF THE INVENTION

1. Field of the Invention:

The invention relates in general to the field of refrigeration having to do with the cooling of air; and in particular to the design of air cooling heat exchangers or coils on which frost deposits during the cooling function; and to the electrical defrosting mechanism which is employed to periodically warm the coils to thaw the frost, leaving the coil in frost-free condition for continued refrigeration at optimum efficiency.

2. DESCRIPTION OF THE PRIOR ART

Refrigeration air cooling units and evaporators having electric defrost heaters have been known for many years. Since frost normally deposits uniformly over the body of the coil, designers have distributed the defrosting heat uniformly over the body of the coil. Experiences have shown that when the coil is warmed by the defrost heaters, the warmed air within the fins tends to rise through the fin pack of the coil by gravity and flow into the cold room. This gravity circulation of air warmed by the defrost heaters has two harmful effects: first, the moisture carried by the warmed air deposits on the internal or external portions of the cooling unit and on the ceiling of the freezer causing frost deposition; second, as air flows out of the coil by convection, fresh, cold air from the freezer enters the coil at the bottom of the fin pack, cooling it and delaying or even defeating the defrosting at that lowest portion. Some designers of refrigeration evaporators have gone so far as to provide movable doors to isolate the evaporator from the freezer during the course of defrost to inhibit this effect. Automatic, movable doors, however, have not always proved to be completely reliable mechanically and have sharply increased the cost of the assembly.

SUMMARY OF THE INVENTION

The invention concerns a vertically disposed cooling coil for refrigeration of the type on which frost deposits during the course of the refrigerating function. The coil is equipped with electric heaters distributed over or throughout the body of the cooling and frosting coil for the purpose of periodically warming it to thaw and disperse the frost deposited during the refrigeration function.

The defrosting coil of the invention has uniformly disposed heaters. Those heaters serving the upper portion of the coil have lower wattage than those heaters serving the lower portion of the coil. The effect of this wattage reduction is that the upper portion of the coil heats at the same rate and to substantially the same final temperatures as the lower portion, instead of overheating. In a coil having uniformly disposed heaters, the reduced electrical heat input to the heaters serving the upper portion is achieved by reducing the wattage of those heaters applied to the upper portion. In an alternate construction, the substantially identical heaters which are positioned to heat the upper portion, instead of being uniformly disposed, can be spaced further apart, so that a given number of watts is spread over a larger portion of the coil.

When coils made in accord with the principles of this invention are used in freezers, it is found that complete defrost occurs substantially more rapidly than similar coils having their heaters uniformly energized, and that the total heat input to the refrigerated space during the course of defrost is reduced by 25 to 50%. This sharp, reduction in heat input during defrost arises from the reduced heat transfer by convection from the defrosting coil to the freezer, which, in turn, allows a shorter duration of defrost. A further substantial power saving arises because the compressor has to operate for a much briefer period following each defrost to remove the heat transferred into the freezer by the defrost process.

DETAILED DESCRIPTION OF THE DRAWINGS

Figure 1:
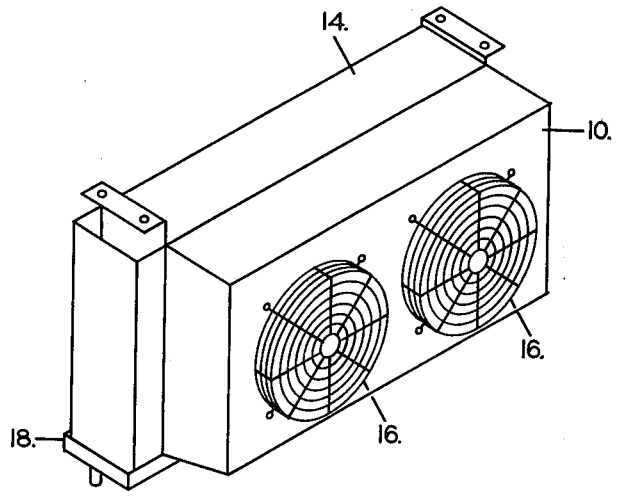
FIG. 1 shows a cooling unit which includes a fan section and a cooling coil or element of the type to which this invention pertains.

FIG. 1 shows a cooling unit having cooling coil 14 with fan section 10 attached to the coil. Located within the fan section 10, but not shown, are fans driven by motors for drawing air over the coil 14 during refrigerating periods. These fans are turned off during the defrost periods.

Figure 2:
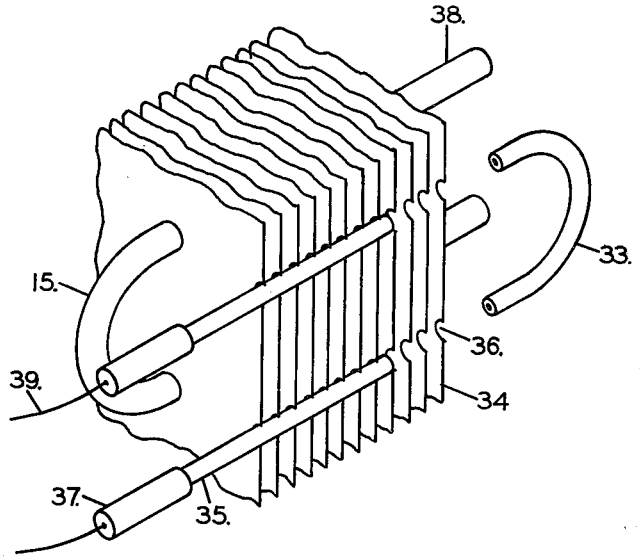
FIG. 2 shows a portion of the cooling coil including two tubes, a return bend, several of the fins and a defrost heater, partly in cross section.

FIG. 2 shows a small portion of one design of coil 14 including tube 38, return bend 15 and fins 34, having generally circular notches 36 in which heater 35 is clamped by means not shown. Heater 35 has U-bend 33 and rubber ends called boots 37 from which wires 39 protrude for connection to a power supply as in FIGS. 7-11. Heater 35 is shown broken to illustrate the semicircular notches in the fin. This heater is generally cylindrical and has an outer sheath 33 of corrosion-resistant material such as copper or nickel, and is heated by a Nichrome (alloy of nickel and chromium) wire which traverses the central axis of the cylindrical sheath and is electrically insulated from it by a matrix of magnesium oxide. The electrical contact to the heating wire at the ends of the heater is made by an iron rod traversing the open end of each heater sheath and spot-welded to the resistance wire. The complete heating element is manufactured by many companies, one of which is General Electric, which sells heaters of this type under their trade-mark, Cal-Rod.

Figure 3:
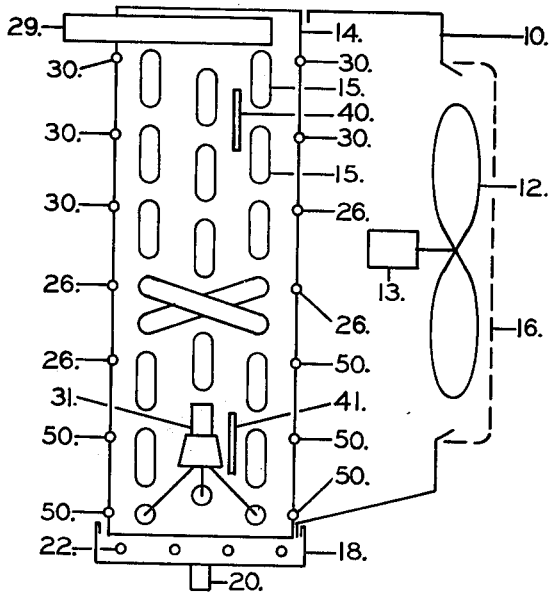
FIG. 3 is a view in elevation, partly in cross section, of the end of the unit in FIG. 1 showing uniformly disposed, non-identical coil heaters. Those heaters applied to the lower section have high wattage, those to the intermediate section have lower wattage, and those applied to the uppermost section have least wattage.

FIG. 3 is an end view of one design of coil 14 of FIG. 1 and a cross-section of the fan section 10 shown in FIG. 1. The fan section 10 includes evaporator fans 12 driven by motors 13, whose shafts couple directly into the hubs of the fans. Partly embedded in and contacting the face of the coil, denoted generally by 14, are high wattage heaters 50 contacting the lower portion of coil 14; reduced wattage heaters 26 contacting the midportion of coil 14; and low wattage heaters 30 contacting the upper portion of coil 14.

The refrigerant inlet of coil 14 is distributor 31 which receives cold volatile or non-volatile refrigerant and distributes it to tubes 38 (not shown, see FIG. 2) which traverse fins 34.

In FIG. 3, only the return bends 15 and connecting tubes 38 are shown. When the refrigerant has traversed all of the tubes of the coil, it leaves by way of outlet manifold 29. When the time comes to initiate a defrost, as determined by a timer, fan motor 13 stops, and coil heaters 50, 26 and 30 and drain pan heaters 22 are energized, warming pan 18 and the individual fins 34 of the coil 14. As the high-wattage heaters 50 warm the lowest coil portion, some convection of warm air occurs into the mid-coil section heated by mid-wattage heaters 26. This tends to equalize the actual heat input to these two portions. The convection of warm air from the mid coil portion, heated by mid-wattage heaters 26, tends to provide additional heat to the uppermost coil section to offset the further decreased wattage of its heaters 30, so that a substantially uniformly heated coil results.

Figure 10:
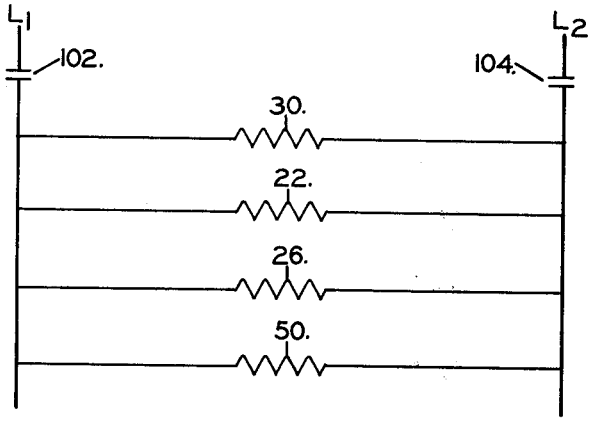
FIG. 10 shows a parallel wiring arrangement that is used with heaters which produce different wattages at the same supply voltage, such as shown in the construction of FIG. 3.

When thermostat 40 in the upper coil portion reaches its preset temperature of 60°, the temperature in the other coil portions are similar and the thermostat 40 acts to open the heater switches 102 and 104 of FIG. 10 and terminate the defrost. With the uniform coil temperatures at termination of defrost there is no overheated coil portion which could tend to unduly promote the harmful and wasteful convection of warm moist air out of the coil.

By contrast, in coils of old design, where all the heaters are of the same wattage, the air at the top of the coil rises to a temperature in the range of 180° at the time the coldest portion of the coil at the bottom approaches 60°. This high coil temperature sharply increases the incentive of air to convect out of the coil. As the air between the fins becomes overheated by virtue of the excessive heating effect of the uniformly distributed heaters, the air rises through the channels between the fins as if these channels were chimneys. The warm, moist air exits at the top of the coil and mixes with the cold room air, warming it; or condenses, depositing its frost on the cold ceiling of the freezer. At the same time, the air that leaves the defrosting coil by convection is replaced by cold freezer air which enters the coil at the bottom, delaying the completion of defrost and encouraging ice formation in the bottom of the coil.

As a matter of good commercial practice, the inventors believe that the heaters adjacent the uppermost portion of the coil should have their heat input to that upper portion adjusted so that the temperature at the end of defrost in the upper portion is slightly lower than the temperature adjacent the high wattage heaters in the lower portion. Then, thermostat 40, at a location within an upper portion of the coil, will reach its preset temperature, for example 60° F., at a time when the remaining portions of the coil will have been already heated to a slightly higher temperature, for example, 70° F. Then, thermostat 40 will cause the heating effect of all the heaters 30, 26, 50 and 22 to stop.

Figure 4:
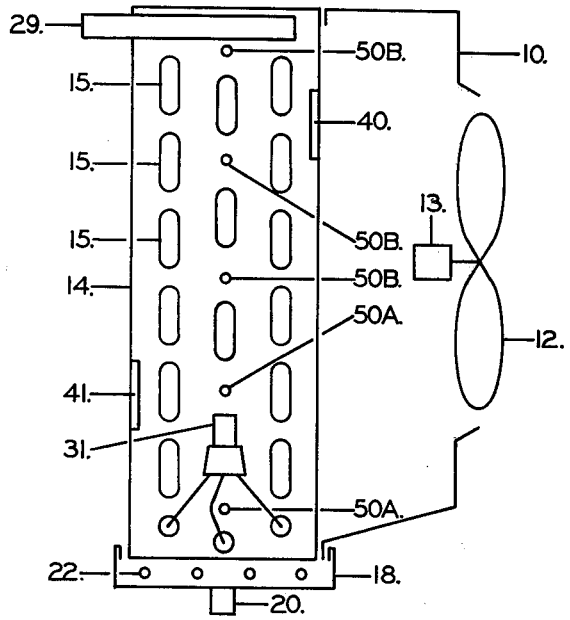
FIG. 4 is a view in elevation partly in cross section of the unit of FIG. 1 showing defrost heaters having uniform wattage centrally and uniformly disposed with respect to the cooling coil for the purpose of warming it for defrosting; and thermostats positioned adjacent the upper and lower coil portions for independently terminating the heating effect of the heaters disposed in the upper and lower portions, according to the wiring of FIG. 8.

In FIG. 4, the heaters 50 are centrally located, inserted through holes in the fins in the body of the coil 9 in a vertical file. Terminating thermostats 40 and 41 have their bulbs located in either fin face and are wired in accord with FIG. 8. Drain pan 18 and pan heaters 22 are the same as in FIG. 3. A typical heater 50, having a length approximately 8 feet, will have a wattage of approximately 1000 when energized across a 230 volt circuit. When the temperature of the fins in the upper portion of coil 9 of FIG. 4 has reached a temperature of approximately 60°, as detected by the bulb of thermostat 40, the thermostat will act to open contacts 60 of FIG. 8 controlling the flow of power to the upper heaters. When the temperature of the fins in the lower portion of coil 9 has reached 60°, as detected by the thermostat 41, contacts 62 will open, stopping the action of the lower heaters 50A. Auxiliary contacts functioning with switches 60 and 62 each close when their associated switch 60 and 62 opens. The auxiliary switches are in series and act to cause the refrigerating function to begin when both heater thermostats are satisfied and their respective switches 60 and 62 are open.

Figure 5:
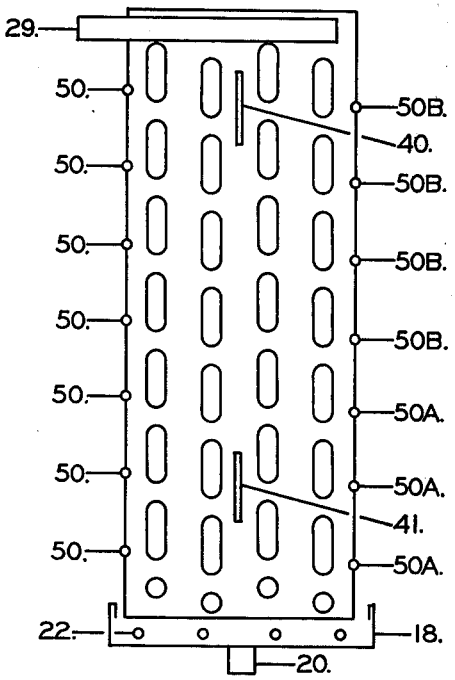
FIG. 5 shows a cross section in elevation of the coil alone of FIG. 1, having defrost heaters of inherently uniform characteristics, uniformly distributed in the coil faces and intended to be utilized with the wiring diagrams of FIGS. 7, 8, 9 or 11 to achieve the objects of the invention.

FIG. 5 shows an end elevation of the coil like that of FIG. 3, except that all of the heaters 50 have substantially identical characteristics. Each horizontal level of heater is identified by the letter A or B. The heaters at level B serve to warm an upper portion of coil 14; the heaters at level A serve to warm the lower portion. Within the framework of the invention, the heaters at level A will operate with a power input of 1000 watts per heater; the heaters at level B will operate with a power input of 250 watts per heater. Experience has shown that, using the principle of the invention with the 50 B heaters operating at 250 watts per heater and the 50 A heaters operating at 1000 watts per heater, there is a total wattage input to the defrosting coil of approximately 9500. Under these conditions, the coil will defrost in 20 minutes. By contrast, if all 24 of the heaters at both level A and level B had been of 600 watts each, the heater wattage used in the units not embodying this invention, the power input to the heaters during defrost would have been 14,400 watts, but the defrost would not have terminated for 40 minutes.

This unlikely result of shorter defrost duration with sharply reduced total defrosting wattage arises because the high wattage-uniform distribution system causes very high air temperatures at the top of the coil, which cause rapid convection of the air from the top of the coil to the box and large quantities of cold air at freezer temperature to enter at the bottom of the coil, preventing it from rising to the required termination temperature and maintaining the frost at the bottom of the coil at a temperature below 32° for extended periods. During the same time that the lower portion of the coil is maintained frozen by the entry of the freezing temperature air, the upper portion of the coil reaches a temperature over 160° F. Experience has shown that the most effective utilization of electrical energy for achieving the most rapid defrost with the least transfer of energy to the box by thermal convection arises when a coil 40" high is divided into two portions, the lower portion being approximately one-third the total height; the upper portion approximately two-thirds the total height, with the heaters in the lower portion having approximately four times the wattage output per heater as the heaters in the upper portion. With this distribution of heat, the terminating thermostat can be located in the position of the bulb 40 in FIG. 5, since the upper portion of the coil will heat slightly more slowly than the lower portion.

Figure 6:
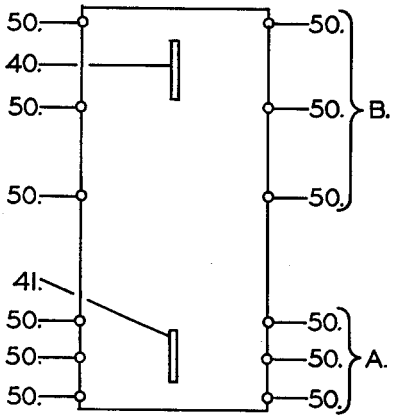
FIG. 6 is a rudimentary cross section in elevation of the coil of FIG. 1, showing heaters having uniform characteristics distributed non-uniformly over the face of the coil for achieving the objects of the invention.

FIG. 6 is a simplified end view of coil 14 with heaters 50 connected in parallel across a common power supply so that the wattage output of all the heaters 50 is identical. In order to achieve the intent of the invention, which is to provide less heat for the upper portion (B) of the coil, the heaters 50, which are intended to affect the upper portion (B) of the coil are spaced further apart, thereby reducing the heat intensity to which the upper portion (B) of the coil is exposed. The heaters 50, which are intended to affect the lower portion (A) of the coil, are spaced much more closely together, so that the intensity and concentration of the heat affecting that lower portion (a) is proportionately increased.

Figure 7:
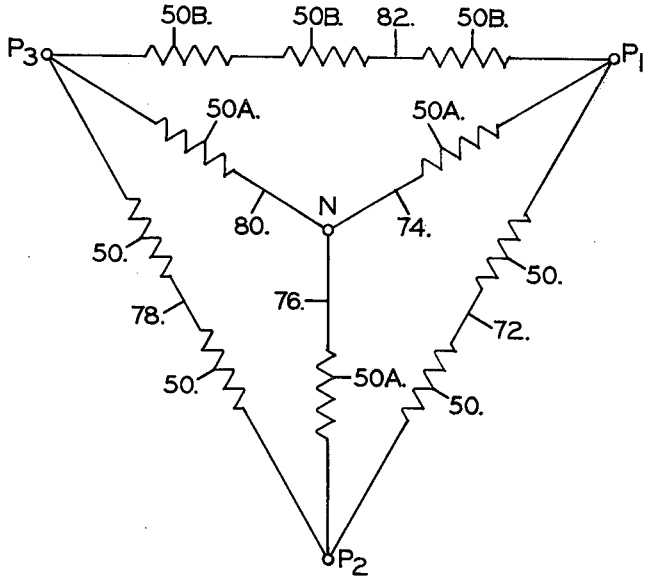
FIG. 7 shows a schematic wiring diagram utilizing 3-phase power supply in a Wye-Delta network for connecting substantially identical coil heaters in a way that produces substantially different heating effects in these heaters.
Figure 8:
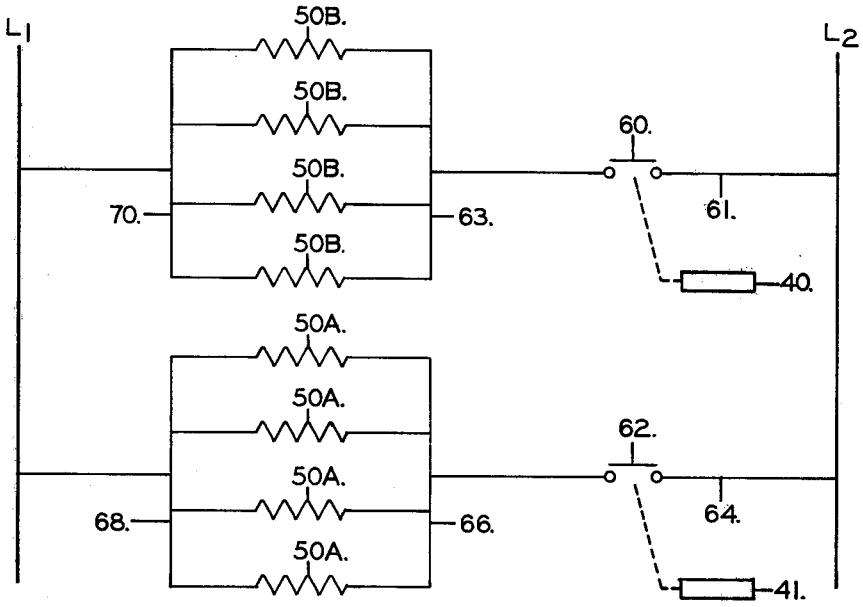
FIG. 8 shows a single phase power supply and heaters arranged in two portions, each individually thermostatically controlled so that the heating effect of the heaters affecting each portion of a coil, such as shown in FIG. 4, can be terminated when the temperature of that portion of the coil has reached a preset value above the thawing temperature of ice.

In order to achieve the varied heat input required by this invention with substantially identical uniformly disposed heaters, the wiring of FIGS. 7, 8, 9 or 11 can be employed. In FIG. 7, a 3-phase power supply is available. With a voltage between T1 and T2 of 460 volts, the two heaters 50 in wire 72 would each have a potential across them of 230 volts. At this voltage each heater 50 dissipates 1000 watts. Where a lesser wattage is required for an intermediate portion of the coil, three heaters can be connected in series between T1 and T3 in conductor 82. These heaters would each have a voltage across them of 153 volts and would generate a wattage per heater of 450. If single phase power supply only is available, the wiring diagrams of FIGS. 8, 9, 10 or 11 can be utilized to provide different wattages from identical heaters. FIG. 8 is a wiring diagram which is directed toward units which have uniformly distributed substantially identical heaters, such as FIGS. 4 and 5. In the wiring diagram of FIG. 8, the heaters are all parallel-connected and therefore have the same wattage. However, bulb 40 of FIGS. 4 and 5, is connected to switch 60 of FIG. 8 and bulb 41 of FIGS. 4 and 5 is connected to switch 62 of FIG. 8. Each bulb is operatively arranged through the mechanism of commonly-known thermostatic devices to open their respective switches when a preset temperature has been reached. Typically, the temperatures of each of thermostatic switches operated by bulbs 40 and 41 will be set to about 60° F. When the heaters in the upper portion of the evaporator have raised the temperature of the thermostat 41 in the upper section to the set point, switch 60 will open, removing heat from the heaters 50 (B). The termination of the heating in the upper portion of the coil therefore prevents the upper portion from overheating. In the meantime, the lower portion of the coil continues its heating operation until the bulb 41, located in the lower portion, warms to its set point of 60° and causes thermostatic switch 62 to open, stopping the heating effect of heaters 50 A located in the lower portion of the coil. In this way, the upper portion of the coil receives less direct heat than the lower portion. This is because, during the initial heating operation, the upper portion of the coil receives direct heat from the electric heaters located adjacent to it, plus convective heat from the heaters 50 A operating on the lower portion of the coil. The augmentation of the direct heat supplied by the 50 B heaters by a part of the heating effect of the lower 50 A heaters, causes the thermostat 40 in the upper portion to terminate the heating effect of these 50 B heaters first. However, the early termination of the heating effect of the 50 B heaters prevents the overheating of the air in the upper section and sharply diminishes the convective circulation of warm moist air out of the coil with a consequential elimination of deferred termination and ice-up in the lower portion of the coil caused by the entry of cold freezer air at the bottom to replace the warm moist air convectively lost at the top.

Figure 9:
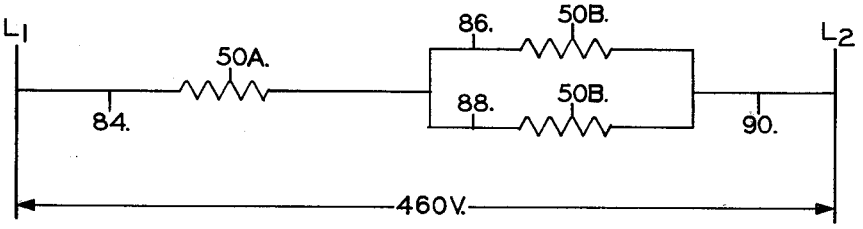
FIG. 9 shows a series-parallel heater arrangement for a single phase power supply whereby heaters having substantially uniform characteristics can be wired to produce different heating effects.

In FIG. 9 the single phase power supply has heaters 50 connected in series-parallel relationship to produce a wattageratio of 4 to 1 between the heater in wire 84 and the heater in parallel network 86, 88. A multiplicity of these series parallel networks are used in the coil arrangements of FIG. 4 or FIG. 5 with the heaters located in wire 84 all being in the A location, that is, positioned to heat the lower portion of the coil, while the heaters in wires 86, 88 are all in the upper or B location of the coil.

Figure 11:
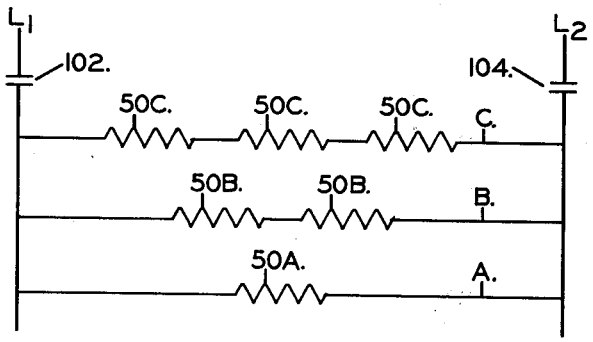
FIG. 11 shows a series parallel wiring arrangement which can be used to secure substantially different heating effects from substantially identical heaters.

FIG. 11 is directed toward the coil structures of FIGS. 4 and 5, both having uniformly distributed heaters with substantially identical characteristics. In the arrangement of FIG. 11, heater 50A, located in wire A directly across the 230 volt network, would produce 1000 watts heating effect. Two identical heaters 50B in series in wire B across the 230 volt network would produce 250 watts each. Three heaters 50C, identical to heaters 50A and 50B, but arranged three in series across the 230 volt network, would produce only 110 watts per heater. In a coil of the nature of FIG. 5, the heaters 50A in circuit A of FIG. 11 would be located in the lowest portion. The heaters 50B in circuit B would be located in a mid-portion and the heaters 50C in circuit C would be located in an uppermost portion.

Though FIG. 5 shows only two such portions; a taller coil like that of FIG. 3 would have need for a third level of heating.

FIG. 10 is directed toward a simple parallel circuit using coil heaters of three different heating characteristics, such as are used in the coil structure of FIG. 3. There the heaters 50 with the highest wattage are located near the bottom of the coil, and the heaters with intermediate wattage 26 are located intermediate the top and bottom of the coil and the heaters 30 with the lowest wattage are located near the top of the coil. The heaters 22 are used in the drain pan.

Figure 12:
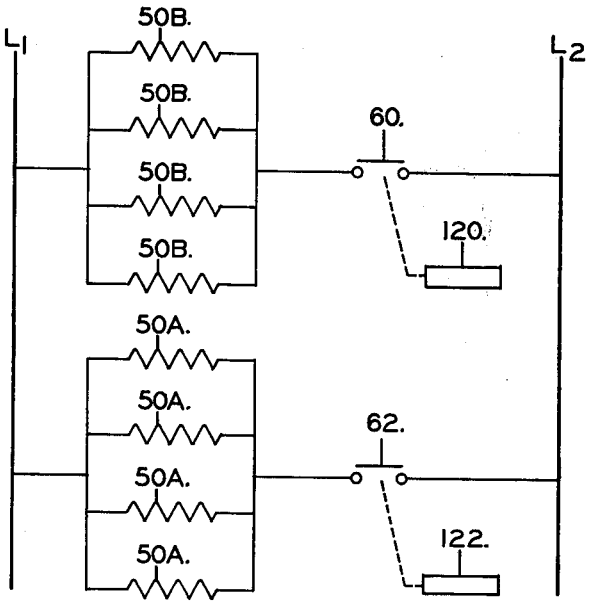

FIG. 12 has timer 120 actuating switch 60 and timer 122 actuating switch 62 with the heating duration of each group of heaters 50A and 50B determined by the respective settings of timers 120 and 122. Typically, timer 120 will terminate the operation of heaters 50B in 5 to 8 minutes; timer 122 will terminate the operation of heaters 50A in 20 minutes, thus achieving the reduced direct heating of the upper portion to achieve substantial equality in net heating effect throughout the defrosting coil.

In an alternate construction, utilizing the timer arrangement of FIG. 11, the timer 120, controlling the 50B heaters, operates on a relatively short repeating cycle, typically 1 minute, and has a cam allowing an operator to select the percentage of the operating cycle during which power is applied to the heaters. The timer 120 controlling the 50B heaters would typically be set to energize the heaters for 15 seconds of each 1 minute cycle.

We claim:

1. An improved method of defrosting a frosting element of an air cooling heat exchange unit, said unit having air cooling periods and defrosting periods, said element comprising a heat exchanger having upper and lower portions; and independent heating means positioned in heat transfer relation to each portion for defrosting it comprising the steps of substantially simultaneously initiating operation of the heating means, terminating the operation of the means relating to a portion, subsequently terminating the operation of the means relating to another portion.

2. An improved method as in claim 1 where the termination of operation of heating means relating to a portion includes the step of sensing the temperature of a portion and terminating operation of a means in response to a rise of said temperature.

3. An improved method as in claim 1 including the step of monitoring time elapsed from the beginning of defrost, terminating the operation of heating means relating to a portion at one time and terminating the operation of heating means relating to another portion at another time.

4. An improved refrigeration air cooling frosting and defrosting heat exchanger including a frosting element having an upper portion and a lower portion; first heating means having a heating rate for heating said upper portion, second heating means having a heating rate for heating said lower portion, wherein the improvement comprises; means for simultaneously defrosting upper and lower portions including means for causing the heating rate of the first heating means to be smaller than the heating rate of the second heating means.

5. An improved cooling unit as in claim 4 where the means includes heaters of different characteristics.

6. An improved cooling unit as in claim 4 where the means includes thermostat means for controlling first heating means.

7. An improved method of defrosting a frosting element of a refrigerating unit having an upper portion including first heating means having an average heating rate for heating that portion, and a lower portion including a second heating means having an average heating rate for heating that portion; where the method comprises the step of establishing a smaller average heating rate for the first means than the second means.

8. An improved method of defrosting as in claim 7 where the step of establishing a smaller average heating rate for the first heating means includes the step of cyclically interrupting the application of heat to said means.

9. An improved refrigeration cooling unit including a frosting element having an upper portion and a lower portion; first heating means having a heating rate for heating said upper portion, second heating means having a heating rate for heating said lower portion, said first and second means having substantially similar heaters, wherein the improvement comprises: electrical circuit means for non-uniformly energizing said heaters.

10. An improved cooling unit as in claim 9, where the electrical circuit means includes a series-parallel-connection.

11. An improved cooling unit as in claim 9, where the electrical circuit means includes a Delta-Wye connection.

12. An improved refrigeration cooling unit including a frosting element having an upper portion and a lower portion; first heating means having a heating rate for heating said upper portion, second heating means having a heating rate for heating said lower portion, wherein the improvement comprises the second heating means having heaters spaced more closely than the heaters of the first heating means whereby the heating rate of the first heating means is caused to be smaller than the heating rate of the second heating means.

13. An improved method of defrosting a frosting element as in claim 7 where the smaller average heating rate for the first means over the second means is achieved by the step of providing heaters of lower wattage for the first means.

* * * * *

UNITED STATES PATENT AND TRADEMARK OFFICE

CERTIFICATE OF CORRECTION

PATENT NO. : 4,152,900

DATED : May 8, 1979

INVENTOR(S) : Ram K. Chopra
Daniel E. Kramer

It is certified that error appears in the above-identified patent and that said Letters Patent are hereby corrected as shown below:

Front page, item 73, assignee: delete "Kramer Trenton Co., Trenton, N. J." and insert in its place --

Kramer Trenton Co., by said Ram K. Chopra only.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*